United States Patent [19]

Lee

[11] Patent Number: 4,926,888

[45] Date of Patent: May 22, 1990

[54] DISPOSABLE ASHTRAY

[76] Inventor: Chin-Ching Lee, No. 10, Lane Nan-E, Ch'ang-shou Rd., Feng-Yuan City, Tai-Chung Hsien, Taiwan

[21] Appl. No.: 274,359

[22] Filed: Nov. 21, 1988

[51] Int. Cl.[5] ..... A24F 19/00; A24F 19/14

[52] U.S. Cl. ..... 131/236; 131/231; 131/256

[58] Field of Search ..... 131/236, 256, 231

[56] References Cited

U.S. PATENT DOCUMENTS 1,666,215 4/1928 Miller ..... 131/236

1,763,678 6/1930 Smith ..... 131/236

*Primary Examiner*—V. Millin

*Attorney, Agent, or Firm*—Kolisch Hartwell & Dickinson

[57] ABSTRACT

A disposable ashtray having a cover, an ashtray body associated with the cover, and a molded block disposed within the body. The block is made of high molecular hydrophilic polymer, and has a plurality of holes in the surface thereof.

1 Claim, 3 Drawing Sheets

DISPOSABLE ASHTRAY

BACKGROUND OF THE INVENTION

The present invention relates generally to ashtrays, and more particularly, to a disposable ashtray wherein an absorption block of high molecular hydrophilic polymer is provided to hold liquid content therein so that the liquid content will not flow out even when the ashtray is inadvertently knocked over.

Conventional ashtrays have some disadvantages. For example, they are expensive and thus are not suited for disposable usage. Therefore, they often need to be cleaned. In addition, for a conventional dry ashtray, the ash therein is apt to float in the air and for a conventional ashtray filled with water, the water will flow out when the ashtray is inadvertently knocked over.

SUMMARY OF THE INVENTION

It is an object of the invention to provide a low cost disposable ashtray which does not need to be cleaned.

Another object of the invention is to provide a disposable ashtray wherein an absorption block of high molecular hydrophilic polymer is provided to hold the water added thereto so that the ash dropped on the block can absorb some water and thus will not be blown in the air, and the water will not flow out of the ashtray even when the latter is inadvertently knocked over.

In accordance with the present invention, there is provided an ashtray body of plastic (in this exemplary case). A cover is associated with the body by hinge means. Within the body is disposed a molded absorption block of high molecular hydrophilic polymer the surface of which is prevented from becoming domed, during expansion of the block when absorbing water, by a plurality of holes formed on the surface thereof that accommodate an increase in volume of the block. The plurality of holes are also provided for extinguishing the cigarettes by inserting the lighted butts thereof into the holes.

An embodiment of the invention will now be described by way of example only with reference to the accompanying drawings.

DETAILED DESCRIPTION OF THE PREFERRED EMBODIMENT

Figure 1:
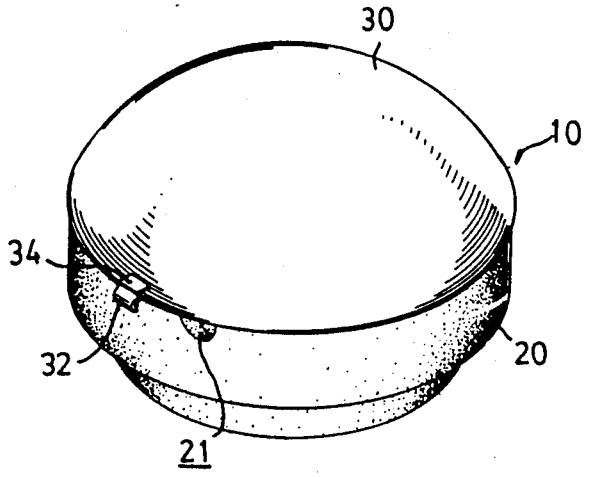
FIG. 1 is a perspective view of a disposable ashtray in accordance with the present invention.

Referring to the drawings, a disposable ashtray in accordance with the present invention is designated by the reference numeral 10. The disposable ashtray 10 includes an ashtray body 20 and a cover 30. The cover 30 is associated with the ashtray body 20 by hinge means 31. Optionally, the ashtray 10 is provided with a locking means which is composed of a hook 32 formed on the cover 30 at a position opposite the hinge means 31 and a protruder 33 formed on the ashtray body 20 at a position corresponding to the hook 32. A lifting means 34 in flat plate form is optionally formed on the cover 30 to easily open the ashtray 10.

Figure 2:
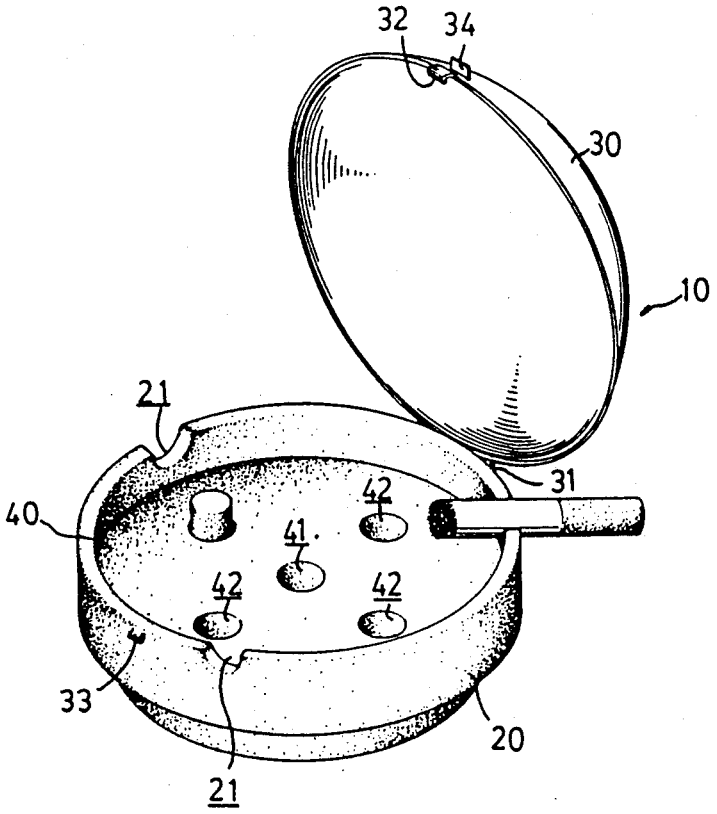
FIG. 2 is a perspective view of the disposable ashtray shown in FIG. 1 with the cover opened to illustrate the inner structure thereof.
Figure 3:
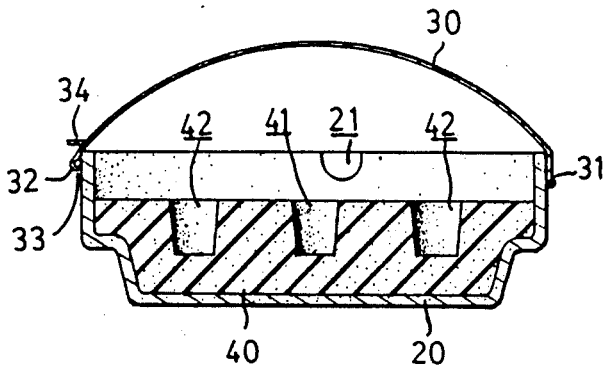
FIG. 3 is a sectional elevation view of the disposable ashtray.

The ashtray body 20 is formed with a plurality of (e.g. three) notches 21 on the top edge thereof for temporarily disposing a cigarette in one of the notches 21. Disposed in the body 20 is a molded absorption block 40 of high molecular hydrophilic polymer capable of holding an appropriate amount of water added thereto so that the ash dropped on the block 40 can absorb some water therefrom and thus will not be blown or suspended in the air. The surface of block 40 is prevented from becoming domed, during expansion of block 40 which is caused by water absorption, by a plurality of holes, which include a central hole 41 and surrounding holes 42, formed on the surface thereof that accommodate an increase in volume of block 40. The plurality of holes also provide an extinguishing means for cigarettes by inserting the lighted butts thereof into the holes 42 (see FIG. 2).

Due to the capability of holding water by the block 40 of high molecular hydrophilic polymer, the water in the ashtray 10 will not flow out even when the ashtray 10 is inadvertently knocked over.

While a particular embodiment of the invention has been shown and described, it is clear that many modifications, variations and alterations will be apparent to those skilled in the art. Therefore, it is intended that such modifications, variations and alterations be within the spirit and scope of the claim.

I claim:

1. In a disposable ashtray having a cover hinged to an ashtray body, which is substantially closable by the cover, an improved insert therefor comprising:

a molded block disposed within the ashtray body, said block being formed of a high molecular hydrophilic polymer and having an upper surface thereof including a plurality of holes formed therein for accommodating an increase in the volume of said block when said block expands when absorbing water, said holes being constructed and arranged to prevent said upper surface from becoming domed during such expansion, said holes also being sized to accommodate a cigarette butt therein for providing an extinguishing means for the cigarette when the cigarette is inserted into one of said holes.

* * * * *